US005163296A

United States Patent [19]

Ziemer et al.

[11] Patent Number: 5,163,296

[45] Date of Patent: Nov. 17, 1992

[54] CRYOGENIC RECTIFICATION SYSTEM WITH IMPROVED OXYGEN RECOVERY

[75] Inventors: John H. Ziemer, Grand Island; Ravindra F. Pahade, Getzville, both of N.Y.

[73] Assignee: Praxair Technology, Inc., Danbury, Conn.

[21] Appl. No.: 774,798

[22] Filed: Oct. 10, 1991

[51] Int. Cl.[5] ..... F25J 3/02

[52] U.S. Cl. ..... 62/24; 62/28; 62/39

[58] Field of Search ..... 62/13, 23, 24, 27, 28, 62/38, 39

[56] References Cited

U.S. PATENT DOCUMENTS

| | | | |
|---|---|---|---|
| 4,303,428 | 12/1981 | Vandenbussche | 62/13 |
| 4,400,188 | 8/1983 | Patel et al. | 62/13 |
| 4,415,345 | 11/1983 | Swallow | 62/28 |
| 4,464,188 | 8/1984 | Agrawal et al. | 62/13 |
| 4,594,085 | 6/1986 | Cheung | 62/25 |
| 4,662,916 | 5/1987 | Agrawal et al. | 62/13 |
| 4,662,917 | 5/1987 | Cormier, Sr. et al. | 61/13 |
| 4,747,860 | 5/1988 | Atkinson | 62/24 |
| 4,883,517 | 11/1989 | Rathbone | 62/24 |
| 4,947,649 | 8/1990 | Agrawal et al. | 62/11 |
| 4,962,646 | 10/1990 | Rathbone | 62/24 |

*Primary Examiner*—Ronald C. Capossela
*Attorney, Agent, or Firm*—Stanley Ktorides

[57] ABSTRACT

A cryogenic rectification system wherein nitrogen top vapor of a higher pressure column reboils the column to provide additional vapor upflow and liquid downflow reflux for increased column drive and improved oxygen recovery.

12 Claims, 2 Drawing Sheets

CRYOGENIC RECTIFICATION SYSTEM WITH IMPROVED OXYGEN RECOVERY

TECHNICAL FIELD

This invention relates generally to cryogenic rectification of mixtures comprising oxygen and nitrogen, e.g. air, and more particularly to the improved production of oxygen by use of such cryogenic rectification.

BACKGROUND ART

Large quantities of oxygen are being increasingly required for use in partial oxidation processes such as those employed in the conversion of coal to liquid or gaseous products and those employed in the conversion of other solid fuels or refuse to useful products. Often an integrated gas turbine system is employed for the production of oxygen for use in these conversion processes. In an integrated gas turbine system, air is extracted from the compressor of the gas turbine system and is fed to a cryogenic air separation plant operating at elevated pressures. Some of the oxygen produced by the air separation plant may serve as oxidant for the gas turbine while most of the oxygen passes to the conversion process. Some of the fuel produced by the conversion process is passed to the gas turbine system as the fuel for the system.

Conversion processes such as are described above require not only very large quantities of oxygen but also oxygen at elevated pressure. Thus, especially in the case when an integrated gas turbine process is employed for the oxygen production, the air separation plant is operated at elevated pressures. Because of the decreased nitrogen to oxygen relative volatility which characterizes elevated pressure air separation plant operation, the recovery of oxygen from the air separation plant decreases with increased operating pressures. It is thus desirable to have a cryogenic separation system which can produce oxygen at elevated pressure and with high recovery.

Accordingly it is an object of this invention to provide a cryogenic rectification method which can produce oxygen at high recovery especially at elevated pressure.

It is another object of this invention to provide a cryogenic rectification apparatus which can produce oxygen at high recovery especially at elevated pressure.

SUMMARY OF THE INVENTION

The above and other objects which will become apparent to one skilled in the art upon a reading of this disclosure are attained by the present invention one aspect of which is:

Cryogenic rectification method comprising:

(A) providing a feed comprising oxygen and nitrogen into a first column and separating the feed in the first column by cryogenic rectification into nitrogen-enriched and oxygen-enriched fluids;

(B) providing nitrogen-enriched and oxygen-enriched fluids from the first column into a second column, operating at a pressure less than that of the first column, and separating these fluids in the second column by cryogenic rectification into oxygen-rich liquid and nitrogen-rich vapor;

(C) condensing a first stream of nitrogen-enriched vapor taken from the first column by indirect heat exchange with oxygen-rich liquid and passing resulting nitrogen-enriched liquid into the first column as reflux, and (D) condensing a second stream of nitrogen-enriched vapor taken from the first column by indirect heat exchange with oxygen-enriched fluid and passing resulting nitrogen-enriched liquid into the first column as additional reflux.

Another aspect of the invention is:

Cryogenic rectification apparatus comprising (A) a first column having a bottom condenser/-reboiler;

(B) a second column having a bottom condenser/-reboiler;

(C) means for providing feed into the first column;

(D) means for passing fluid from the upper portion of the first column, through the bottom condenser/-reboiler of the second column and back into the upper portion of the first column;

(E) means for passing fluid from the upper portion of the first column, through the bottom condenser/-reboiler of the first column and back into the upper portion of the first column; and (F) means for recovering fluid from the second column.

As used herein the term "oxygen recovery" means the percentage of oxygen contained in the product oxygen streams compared to the oxygen contained in the feed stream.

As used herein, the term "bottom condenser/-reboiler" means a heat exchange system in which an oxygen-containing liquid from the bottom of a column is boiled by indirect heat exchange against a nitrogen-containing vapor which is condensed.

As used herein the term, "column", means a distillation or fractionation column or zone, i.e., a contacting column or zone wherein liquid and vapor phases are countercurrently contacted to effect separation of a fluid mixture, as for example, by contacting of the vapor and liquid phases on a series or vertically spaced trays or plates mounted within the column and/or on packing elements. For a further discussion of distillation columns see the Chemical Engineers' Handbook. Fifth Edition, edited by R. R. Perry and C. H. Chilton, McGraw-Hill Book Company, New York, Section 13, "Distillation" B. D. Smith et al, page 13–3, *The Continuous Distillation Process.* The term, double column is used to mean a higher pressure column having its upper end in h eat exchange relation with the lower end of a lower pressure column. A further discussion of double columns appears in Ruheman "The Separation of Gases" Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is adiabatic and can include integral or differential contact between the phases. Separation process arrangements that utilize the principles of rectification to separate mixtures are often interchangeably termed rectification columns, distillation columns, or fractionation columns. Cryogenic rectification is a rectification process carried out, at least in part, at low temperatures such as at temperatures at or below 300 degrees Kelvin.

As used herein the term "indirect heat exchange" means the bringing of two fluid streams into heat exchange relation without any physical contact or intermixing of the fluids with each other.

DETAILED DESCRIPTION

This invention comprises in general a recycle of a portion of the nitrogen top vapor from the higher pressure column of a double column system. This top vapor portion is condensed against the higher pressure column bottoms and is returned into the higher pressure column as additional reflux. In addition the condensation of the top vapor portion serves to produce additional higher pressure column upflow vapor which, combined with the additional reflux, generates a higher oxygen recovery despite operation of the cryogenic rectification system at elevated pressure.

The invention will be described in detail with reference to the Drawings.

Figure 1:
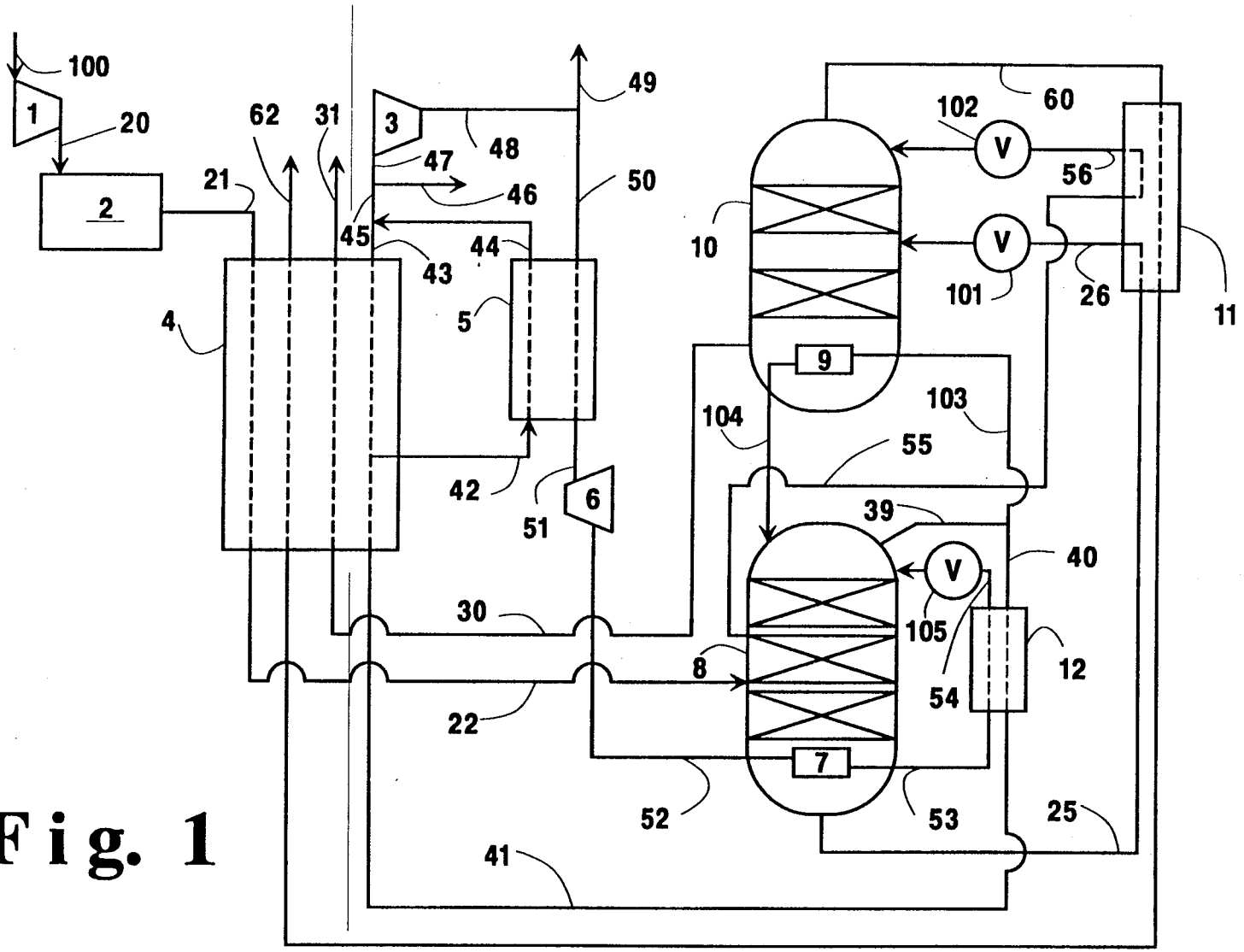
FIG. 1 is a schematic flow diagram of one preferred embodiment of the cryogenic rectification system of this invention.

Referring now to FIG. 1, feed 100 comprising oxygen and nitrogen, e.g. air, is compressed by passage through compressor 1 to an elevated pressure, generally within the range of from 130 to 250 pounds per square inch absolute (psia). Elevated pressure feed 20 is then cleaned of high boiling impurities such as carbon dioxide and water vapor by passage through precleaning unit 2, and cleaned feed stream 21 is passed through heat exchanger 4. Within heat exchanger 4 the cleaned, elevated pressure feed is cooled from about ambient temperature to near its saturated temperature by indirect heat exchange with return steams as will be described later. The cleaned, cooled, elevated pressure feed 22 is then passed into first column 8.

First column 8 is the higher pressure column of a double column system comprising columns 8 and 10. First column 8 has a bottom condenser/reboiler 7 and is operating at an elevated pressure generally within the range of from about 120 to 300 psia. Within first column 8 the feed is separated by cryogenic rectification into nitrogen-enriched fluid and oxygen-enriched fluid. Oxygen-enriched fluid is passed as liquid steam 25 out of first column 8, is subcooled by passage through heat exchanger 11 by indirect heat exchange with a return stream, and then passed as stream 26 through valve 101 and into second column 10. Nitrogen-enriched fluid is passed as liquid stream 55 out of first column 8, is subcooled by passage through heat exchanger 11 by indirect heat exchange with a return stream, and then passed as stream 56 through valve 102 and into second column 10.

Second column 10 is the lower pressure column of the double column system and has a bottom condenser/reboiler 9. Second column 10 is operating at a pressure less than that of first column 8 and generally within the range of from 25 to 100 psia. Within second column 10 the fluids provided into the column are separated by cryogenic rectification into nitrogen-rich vapor and oxygen-rich liquid. Nitrogen-rich vapor is removed from second column 10 as waste nitrogen stream 60, is heated by passage through heat exchangers 11 and 4 as was previously described, and passed out of the system as stream 62. Oxygen-rich liquid is boiled at the bottom of second column 10 and resulting oxygen-rich vapor is removed from the column as stream 30, warmed by passage through heat exchanger 4 and recovered as product oxygen 31 having a purity exceeding 85 percent and generally within the range of from 95 to 99.5 percent.

The upper portion of first column 8 contains nitrogen-enriched fluid as top vapor. In the broadest sense the upper portion of the column comprises the top half of the column by height. However, preferably the upper portion of the column is that portion of the column above the vapor-liquid contact internals which may be trays and/or packing. Nitrogen-enriched vapor is passed out of the upper portion of first column 8 as stream 39 and a first portion 103 of stream 39, said first portion comprising a first stream of nitrogen-enriched vapor taken from first column 8, is passed through bottom condenser/reboiler 9 wherein it condenses by indirect heat exchange with boiling oxygen-rich liquid as was previously discussed. This reboiling generally is carried out at a pressure within the range of from 30 to 120 psia. Resulting nitrogen-enriched liquid 104 is passed back into the upper portion of first column 8 as reflux.

A second portion 40 of stream 39, said second portion comprising a second stream of nitrogen-enriched vapor taken from first column 8, is warmed by passage through heat exchanger 12 and resulting stream 41 is passed into heat exchanger 4. A fraction 42 of stream 41 is withdrawn from heat exchanger 4 after it has been warmed by partial traverse while another fraction 43 is warmed by total traverse of heat exchanger 4. Fraction 42 is warmed by passage through heat exchanger 5 and resulting stream 44 is recombined with stream 43 downstream of heat exchanger 4 to form stream 45. A portion 46 of stream 45 may be recovered as medium pressure product nitrogen, generally at a pressure within the range of from 120 to 240 psia. The remaining portion 47 of stream 45 is compressed by passage through compressor 3 to a pressure generally within the range of from 400 to 1200 psia and a high pressure stream 48 is taken from compressor 3. A portion 49 of stream 48 is recovered as high pressure product nitrogen. The medium pressure and high pressure nitrogen product has a maximum oxygen content of 5.0 percent and generally the oxygen content is within the range from 0.1 to 0.001 percent. One advantage of the invention, in addition to improved oxygen recovery, is that the entire nitrogen product may be produced at the elevated pressure of the higher pressure column. This maximizes the nitrogen product supply pressure from the cryogenic rectification process thus reducing product nitrogen compression requirements.

Another portion 50 of stream 48 is cooled by passage through heat exchanger 5 by indirect heat exchange with stream 42 as was previously discussed. Resulting desuperheated stream 51 is expanded by passage through expansion engine 6 to generate plant refrigeration. Expanded stream 52 from expansion engine 6 is then passed into bottom condenser/reboiler 7. Generally the flowrate of the stream passed into the bottom condenser/reboiler of first column 8 will be within the range of from 1 to 20 percent, typically 1 to 15 percent, of the molar flowrate of feed stream 100.

As mentioned stream 52 is passed into bottom condenser/reboiler 7 wherein it is at least partially condensed and preferably completely condensed by indirect heat exchange with boiling oxygen-enriched liquid. This reboiling generally is carried out at a pressure with range of from 150 to 400 psia. This provides additional upflowing vapor to drive the separation in first column 8. Resulting stream 53 from bottom condenser/reboiler 7 is cooled by passage through heat exchanger 12 by indirect heat exchange with warming nitrogen-enriched vapor stream 40 as was earlier discussed and resulting stream 54 is throttled through valve 105 and passed into the upper portion of first column 8 as additional reflux. The additional upflowing vapor and additional reflux liquid improves the separation accomplished in the high pressure column resulting in increased reflux flow, in stream 55, to the lower pressure column. Increased reflux to the top of the lower pressure column results in improved oxygen recovery in the lower pressure column.

With the use of the cryogenic rectification system of this invention one can achieve improved oxygen recoveries at elevated operating pressures. Generally the oxygen recovery attainable with the invention will be at least 90 percent and typically will be within the range of from 95 to 99 percent or more, depending, inter alia, upon the operating pressures and overall economic optimization.

Figure 2:
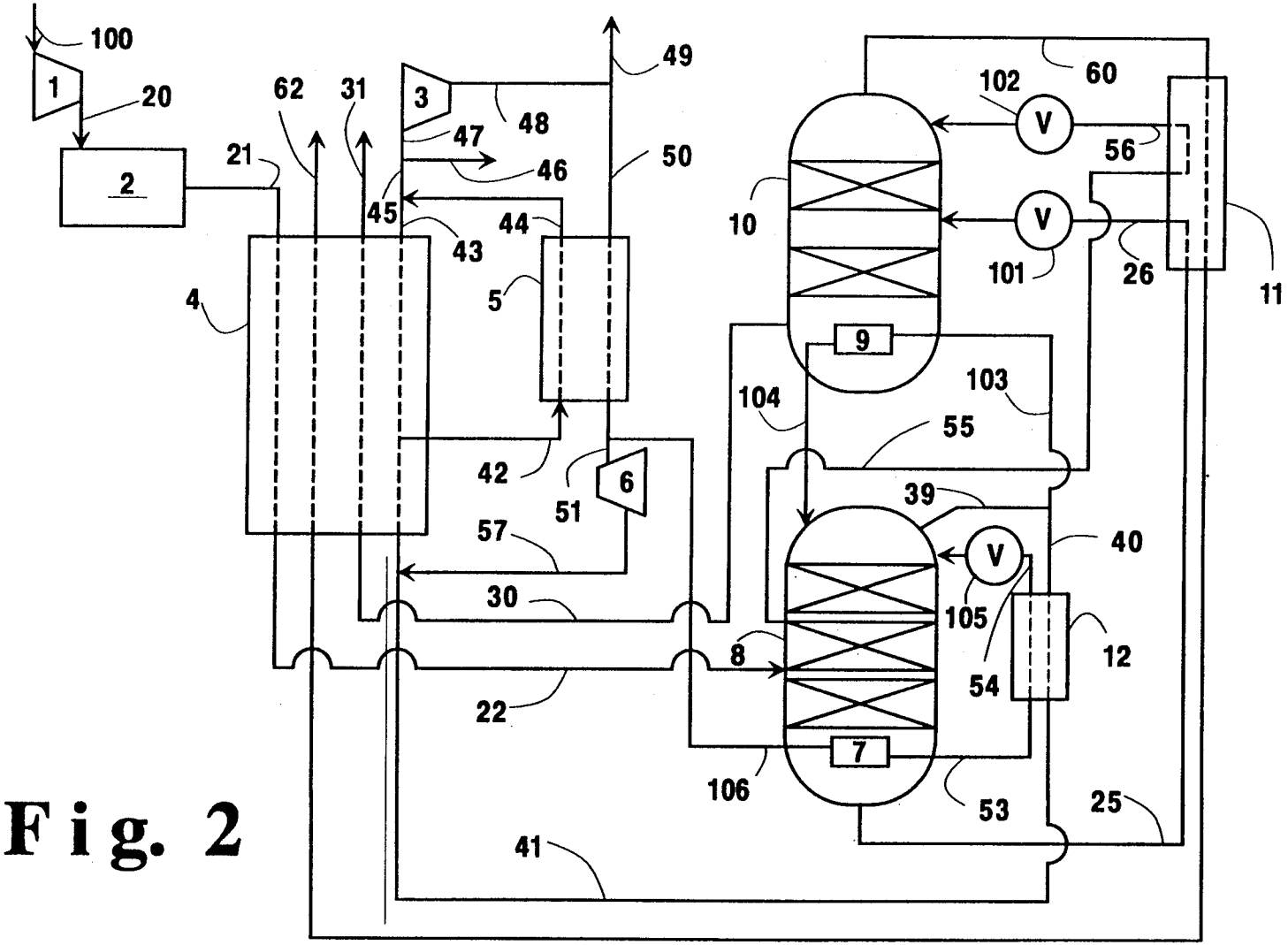
FIG. 2 is a schematic flow diagram of another preferred embodiment of the cryogenic rectification system of this invention.

FIG. 2 illustrates another embodiment of the invention wherein the stream passed through bottom condenser/reboiler 7 is not expanded prior to the reboiling. The numerals of FIG. 2 are the same as those of FIG. 1 for the common elements and these common elements will not be discussed in detail again. In the embodiment of FIG. 2 a portion 106 of stream 51 bypasses expansion engine 6 and this high pressure portion 106 is passed into bottom condenser/reboiler 7 to carry out the reboiling in a manner similar to that described in association with the embodiment illustrated in FIG. 1. The remainder of stream 51 is expanded through expansion engine 6 to generate plant refrigeration and resulting stream 57 from expansion engine 6 is combined with stream 41 and passed through heat exchanger 4 wherein refrigeration is passed into feed stream 21 and then into the double column system.

In the embodiment illustrated in FIG. 1, the entire recycle stream is expanded in the expansion engine 6 and then piped to the condenser/reboiler 7. The refrigeration production is thereby tied to the column recovery. This arrangement will be near optimum for many applications. In the embodiment illustrated in FIG. 2, the flow of recycle to the expansion engine is independent of the recycle flow to the condenser/reboiler. This embodiment is advantageous for applications where expander flow requirements exceed column recyle flow requirements.

Now by the use of the cryogenic rectification method and apparatus of this invention one can produce elevated pressure oxygen with high recovery. Although the invention has been described in detail with reference to certain preferred embodiments, those skilled in the art will recognize that there are other embodiments of the invention within the spirit and the scope of the claims.

I claim:

1. Cryogenic rectification method comprising:

(A) providing a feed comprising oxygen and nitrogen into a first column and separating the feed in the first column by cryogenic rectification into nitrogen-enriched and oxygen-enriched fluids;

(B) providing nitrogen-enriched and oxygen-enriched fluids from the first column into a second column, operating at a pressure less than that of the first column, and separating these fluids in the second column by cryogenic rectification into oxygen-rich liquid and nitrogen-rich vapor;

(C) condensing a first stream of nitrogen-enriched vapor taken from the first column by indirect heat exchange with oxygen-rich liquid and passing resulting nitrogen-enriched liquid into the first column as reflux;

(D) condensing a second stream of nitrogen-enriched vapor taken from the first column by indirect heat exchange with oxygen-enriched fluid and passing resulting nitrogen-enriched liquid into the first column as additional reflux; and (E) recovering fluid from the second column having an oxygen concentration exceeding 85 percent.

2. The method of claim 1 wherein the second stream of nitrogen-enriched vapor is compressed prior to the condensation by indirect heat exchange with oxygen-enriched fluid.

3. The method of claim 2 wherein the compressed second stream of nitrogen-enriched vapor is expanded prior to the condensation by indirect heat exchange with oxygen-enriched fluid.

4. The method of claim 2 wherein the compressed second stream of nitrogen-enriched vapor is not expanded prior to the condensation by indirect heat exchange with oxygen-enriched fluid.

5. The method of claim 1 wherein the nitrogen-enriched vapor condensing by indirect heat exchange with oxygen-enriched fluid has a flowrate within the range of from 1 to 20 percent of the flowrate of the feed.

6. The method of claim 1 wherein the feed is air.

7. The method of claim 1 wherein the condensation of the first stream of nitrogen-enriched vapor taken from the first column by indirect heat exchange with oxygen-rich liquid produces oxygen-rich vapor which is passed out of the second column and recovered as product oxygen.

8. The method of claim 1 wherein the second stream of nitrogen-enriched vapor taken from the first column is part of a larger stream a part of which is recovered as nitrogen product.

9. The method of claim 8 wherein the nitrogen product is recovered as a medium pressure product stream and as another stream which undergoes compression and is recovered as a high pressure product stream.

10. Cryogenic rectification apparatus comprising:

(A) a first column having a bottom condenser/-reboiler;

(B) a second column having a bottom condenser/-reboiler;

(C) means for providing feed into the first column;

(D) means for passing fluid from the upper portion of the first column, through the bottom condenser/-reboiler of the second column and back into the upper portion of the first column;

(E) means for passing fluid from the upper portion of the first column, through the bottom condenser/-reboiler of the first column and back into the upper portion of the first column; and (F) means for recovering fluid from the second column having an oxygen concentration exceeding 85 percent.

11. The apparatus of claim 10 further comprising a compressor on the means for providing the fluid from the upper portion of the first column to the bottom condensor/reboiler of the first column.

12. The apparatus of claim 1 further comprising an expansion engine on the means for providing fluid from the upper portion of the first column to the bottom condenser/reboiler of the first column, said expansion engine being between the compressor and the bottom condenser/reboiler of the first column.

* * * * *

UNITED STATES PATENT AND TRADEMARK OFFICE

CERTIFICATE OF CORRECTION

PATENT NO. : 5,163,296

DATED : November 17, 1992

INVENTOR(S) : John H. Ziemer, et al.

It is certified that error appears in the above-identified patent and that said Letters Patent is hereby corrected as shown below:

In claim 12, col. 8, line 1, delete "1" and insert therefor --11--.

Signed and Sealed this

Twelfth Day of October, 1993

*Attest:*

*Attesting Officer*

Bruce Lehman

BRUCE LEHMAN

*Commissioner of Patents and Trademarks*